US005973543A

United States Patent [19]

Shimura

[11] Patent Number: 5,973,543

[45] Date of Patent: Oct. 26, 1999

[54] BIAS CIRCUIT FOR BIPOLAR TRANSISTOR

[75] Inventor: Teruyuki Shimura, Tokyo, Japan

[73] Assignee: Mitsubishi Denki Kabushiki Kaisha, Tokyo, Japan

[21] Appl. No.: 08/825,220

[22] Filed: Mar. 27, 1997

[30] Foreign Application Priority Data

Jul. 29, 1996 [JP] Japan ..... 8-198844

[51] Int. Cl.[6] ..... G05F 1/10

[52] U.S. Cl. ..... 327/530; 327/535

[58] Field of Search ..... 327/309, 315, 327/318, 324, 327, 328, 378, 379, 478, 432, 530, 534, 535, 537, 538, 542, 543

[56] References Cited

FOREIGN PATENT DOCUMENTS 3101511 4/1991 Japan .

6120748 4/1994 Japan .

*Primary Examiner*—Timothy P. Callahan
*Assistant Examiner*—Jeffrey Zweizig
*Attorney, Agent, or Firm*—Leydig, Voit & Mayer

[57] ABSTRACT

A bias circuit for a bipolar transistor includes a constant voltage source connected to a base electrode of the bipolar transistor; and a resistor connected in series between the constant voltage source and the base electrode of the bipolar transistor. By selecting an appropriate resistance for this resistor, the bias point moves due to a change in the voltage drop across the resistor. The change occurs because the base current flowing through the resistor changes, whereby the operating class of the transistor changes, resulting in a high efficiency at a desired output power.

7 Claims, 13 Drawing Sheets

Fig.15 Prior Art

| Pin(dBm) | Pout(dBm) | Gain(dB) | $V_{BE}$(V) | $I_{CE}$(mA) | $\eta$ add(%) | colllector elliciency (%) |
|---|---|---|---|---|---|---|
| -4 | 2.93 | 6.93 | 1.318 | 11.65 | 1.7 | 2.1 |
| -2 | 4.95 | 6.95 | 1.320 | 11.77 | 2.6 | 3.3 |
| 0 | 6.98 | 6.98 | 1.321 | 11.95 | 4.2 | 5.2 |
| 2 | 9.01 | 7.01 | 1.322 | 12.25 | 6.5 | 8.1 |
| 4 | 11.06 | 7.06 | 1.324 | 12.71 | 10.1 | 12.6 |
| 6 | 13.13 | 7.13 | 1.328 | 13.42 | 15.4 | 19.1 |
| 8 | 15.21 | 7.21 | 1.331 | 14.41 | 23.3 | 28.8 |
| 9 | 16.25 | 7.25 | 1.332 | 15.21 | 28.1 | 34.7 |
| 10 | 17.27 | 7.27 | 1.330 | 16.40 | 33.0 | 40.7 |
| 11 | 18.27 | 7.27 | 1.321 | 17.00 | 40.1 | 49.4 |
| 12 | 19.22 | 7.22 | 1.296 | 18.10 | 46.8 | 57.7 |
| 13 | 19.99 | 6.99 | 1.239 | 18.97 | 52.6 | 65.7 |
| 14 | 20.33 | 6.33 | 1.062 | 18.21 | 56.8 | 74.1 |
| 15 | 20.35 | 5.35 | 0.77 | 16.95 | 56.6 | 79.9 |
| 16 | 20.37 | 4.37 | 0.466 | 16.35 | 52.8 | 83.3 |

BIAS CIRCUIT FOR BIPOLAR TRANSISTOR

FIELD OF THE INVENTION

The present invention relates to a bias circuit connected to a base electrode of a bipolar transistor.

BACKGROUND OF THE INVENTION

FIG. 14 is a block diagram illustrating a circuit structure of a portable telephone in general use. In FIG. 14, reference numeral 101 designates an antenna, numeral 102 designates a duplexer (hereinafter referred to as a DUP), numeral 103 designates a low noise amplifier (hereinafter referred to as an LNA) for amplifying an input signal, and numeral 104 designates a demodulator for demodulating the signal amplified by the LNA 103. Reference numeral 105 designates a frequency synthesizer, numeral 106 designates an analog-to-digital converter (hereinafter referred to as an ADC) for converting an analog signal output from the demodulator 104 into a digital signal, and numeral 107 designates a temperature compensated crystal oscillator (hereinafter referred to as a TCXO). Reference numeral 108 designates a signal processor, numeral 109 designates a digital signal processor (hereinafter referred to as a DSP), numeral 110 designates an ADC for converting an analog signal from a microphone 111 into a digital signal and outputting the digital signal to the DSP 109, numeral 112 designates a digital-to-analog converter (hereinafter referred to as a DAC) for converting a digital signal output from the DSP 109 into an analog signal and outputting the analog signal to a speaker 113, numeral 114 designates a controller, numeral 115 designates a display, such as a liquid crystal display, numeral 116 designates a console provided with input buttons, such as numeric keys, and numeral 117 designates a memory. Reference numeral 118 designates a DAC for converting a digital signal output from the signal processor into an analog signal, numeral 119 designates an orthogonal modulator for orthogonally modulating a signal output from the DAC 118, and numeral 120 designates an amplifier for amplifying a signal output from the orthogonal modulator 119.

In the transmitter side amplifier 120 (high power amplifier) in the portable telephone thus constructed, a bipolar transistor is usually used as an amplifier element to amplify a microwave signal output from the orthogonal modulator 119 with high efficiency. Besides, bipolar transistors are used as amplifier elements in a high power amplifier for transmission from a base station and in a high power amplifier mounted on a communication satellite.

There are only two operating modes of a bipolar transistor, i.e., a base voltage ($V_B$) constant operating mode and a base current ($I_B$) constant operating mode. These modes have their respective merits and demerits.

FIG. 15 shows measurement results of I/O characteristics of an HBT (Heterojunction Bipolar Transistor) with a single emitter having a size of 2×20 $\mu m^2$. The bias conditions are $V_{CE}$=8 V and $I_B$=1.75 mA, that is, $V_{CE}$ and $I_B$ are constant. The measuring frequency is 18 GHz. Here, "constant" means that the time average of $V_{CE}$ (I) is constant.

As shown in FIG. 15, when $P_{in}$ is higher than 11 dBm, the base voltage ($V_{BE}$) decreases. In FIG. 15, $V_{BE}$ is the time average of the base voltage $V_{BE}$.

In FIG. 15, when $P_{in}$ is 14 dBm, providing the highest efficiency, $V_{BE}$ is already as low as 1.062 V. Since the ON voltage of the HBT is about 1.30 V, the change of $V_{BE}$ with the passage of time is as shown in FIG. 16(*a*). Since the collector current ($I_{CE}$) does not flow at a voltage lower than the ON voltage, the change of $I_{CE}$ with the passage of time is as shown in FIG. 16(*b*). That is, $I_{CE}$ flows like a pulse only when $V_{BE}$ exceeds the ON voltage (about 1.30 V). Therefore, class "C" operation of the transistor is realized, resulting in a high efficiency operation of the transistor. When $P_{in}$=−4 dBm, $V_{BE}$=1.318 V and $I_{CE}$=11.65 mA. Therefore, when the input amplitude is small, the transistor performs in class "A" operation. With an increase in the input amplitude, the operation class changes automatically from "B" ($P_{in}$=12 dBm) to "C" ($P_{in}$≧13 dBm).

A description is given of the reason why the bias point changes from "A" at the initial setting, through "B" to "C". In the example mentioned above, the measuring conditions are $V_{CE}$=8 V (constant) and $I_B$=1.75 mA (constant). Here, "constant" means that the time average of $V_{CE}$ ($I_B$) is constant. However, since it is unthinkable that $V_{CE}$ vary with the input amplitude, the bias point cannot get move off the line of $V_{CE}$=8 V. In addition, "$I_B$ is constant" means $$I_B = \frac{I_B(t)dt}{\Delta t} = \text{constant} \tag{1}$$

FIG. 17 shows load curves on the assumption that the bias point Q does not move with an increase in the input amplitude. Hereinafter, an investigation is made into a case where the input amplitude is small ($P_{in1}$), and a case where the input amplitude is large, and the output current amplitude is already restricted by the x axis ($I_{CE}$=0 mA) on the high $V_{CE}$ side and moves along the x axis ($P_{in2}$ ). FIGS. 18(*a*) and 18(*b*) show changes of $I_B$ and $I_{CE}$ with the passage of time, respectively, in the case of $P_{in1}$. FIGS. 19(*a*) and 19(*b*) show changes of $I_B$ and $I_{CE}$ with the passage of time, respectively, in the case of $P_{in2}$.

The fact that the bias point Q does not move means that the center of the amplitude of $I_B$ is on $I_B$=1.75 mA. In order to satisfy formula (1), hatched regions A and B in FIG. 18(*a*) must have the relationship of A=B, and hatched regions A' and B' in FIG. 19(*a*) must have the relationship of A'=B'. In FIG. 18(*a*), A=B is realized because $I_B$ does not become 0. However, in FIG. 19(*a*) where the input amplitude is large, since $I_B$ cannot take a negative value, A'<B' results, so that formula (1) is not satisfied. So, in order to increase the input amplitude with formula (1) being satisfied, the bias point Q moves downward along the line of $V_{CE}$=8 V. FIG. 20 shows load curves in the case where the bias point Q moves downward. As shown in FIG. 20, with an increase in the input amplitude ($P_{in1}$→$P_{in2}$→$P_{in3}$), the bias point moves downward ($Q_1$→$Q_2$→$Q_3$) to satisfy formula (1). FIGS. 21(*a*) and 21(*b*), 21(*c*) and 21(*d*), and 21(*e*) and 21(*f*), respectively show changes of $I_B$ and $I_{CE}$ with time at the input levels $P_{in1}$, $P_{in2}$, and $P_{in3}$, respectively. In order to satisfy formula (1), the area of the hatched region in the figure must always be constant ($I_B$ (=1.75 mA)×Δt). In order to make the area constant, an increment in the area due to the increase in the amplitude is canceled, whereby the center value of the amplitude is lowered. In other words, the bias point Q moves downward. As shown in FIGS. 16(*a*) and 16(*b*), under a condition where the efficiency attains the maximum value, since $V_{BE}$ (=1.06 V) is lower than the ON voltage, it is thinkable that the transistor is in the state of $P_{in3}$, so that the class "C" operation of the transistor is realized, resulting in a high-efficiency operation of the transistor. This result is attributed to the fact that the theoretical efficiency attained in the class "C" operation of the bipolar transistor is 100% whereas the theoretical efficiency attained in the class "AB" operation is about 70% at best.

As described above, when a bipolar transistor is operated by a bias circuit with constant $I_B$ since $V_B$ drops, the bias point, i.e., the operating class, changes (for example, "AB"→"B"→"C"), whereby a high efficiency is achieved while maintaining a linear of gain.

However, the reduction of $V_B$ with the increase in $P_{in}$ causes a disadvantage that $P_{out}$ does not increase. For example, when a bipolar transistor used as an amplifier in a portable telephone is operated by a bias circuit with constant $I_B$, an output power needed when the telephone is used in a place distant from the base station is not sufficiently obtained. In order to increase $P_{out}$ ($I_C$) in the $I_B$ constant operating mode, $I_B$ must be increased. However, since to increase $I_B$ is to increase the initial bias current ($I_{idle}$) in the state with no input signal ($P_{in}$), the efficiency decreases in the region where $P_{in}$ is low. In addition, when $I_{idle}$ is high, the power consumption increases and the junction temperature increases.

On the other hand, in the $V_B$ constant operating mode, since $I_B$ and $I_C$ (collector current) increase with an increase in the RF input ($P_{in}$), the RF output ($P_{out}$) increases, whereby a $P_{out}$ higher than a certain value is secured even though the initial bias current ($I_{idle}$) is lowered. However, since $V_B$ is constant, the bias point, i.e., the operating class, is fixed. As a result, a high efficiency cannot be realized while maintaining linearity of gain.

As described above, in the conventional bias circuit for operating a bipolar transistor, the bipolar transistor is operated with a constant base voltage or a constant base current. However, in a bias circuit with a constant base voltage, a high efficiency cannot be realized while maintaining linearity of gain. On the other hand, in the bias circuit with a constant base current, a sufficient output power cannot be obtained when the input amplitude is large.

SUMMARY OF THE INVENTION

It is an object of the present invention to provide a bias circuit that realizes an operating mode having the merits of the $V_B$ constant operating mode and the $I_B$ constant operating mode.

It is another object of the present invention to provide a bias circuit that provides a sufficient output power without increasing the initial bias current $I_{idle}$ even in the $I_B$ constant operating mode.

Other objects and advantages of the invention will become apparent from the detailed description that follows. The detailed description and specific embodiments described are provided only for illustration since various additions and modifications within the scope of the invention will be apparent to those of skill in the art from the detailed description.

According to a first aspect of the present invention, a bias circuit for a bipolar transistor comprises a constant voltage source connected to a base electrode of the bipolar transistor; and a resistor connected in series between the constant voltage source and the base electrode of the bipolar transistor. Therefore, by selecting an appropriate resistance of this resistor, the bias point moves due to a change in voltage drop by the resistor, which change is caused by that the base current flowing through the resistor changes, whereby the operating class of the transistor changes, resulting in a high efficiency at a desired output power ($P_{out}$).

According to a second aspect of the present invention, the above-mentioned bias circuit for a bipolar transistor comprises a diode and a first resistor connected in series with each other and in parallel with said resistor, between the constant voltage source and the base electrode of the bipolar transistor, and the resistor has a resistance higher than the sum of the resistance of the diode when it is conducting and the resistance of the first resistor. Therefore, when the base voltage becomes lower than the threshold voltage of the diode due to an increase in the voltage drop by the diode and the first resistor, which increase is caused by that the base current flowing through the diode and the first resistor increases, the base current flows through the second resistor, whereby the bias point moves rapidly due to the voltage drop by the second resistor, and the operating class of the transistor changes, resulting in a high efficiency at a desired output power.

According to a third aspect of the present invention, a bias circuit for a bipolar transistor comprises a constant current source connected to a base electrode of the bipolar transistor; and a resistor and a diode connected in series between a node of the constant current source and the base electrode of the bipolar transistor, and a grounding voltage terminal. Therefore, in the initial stage, a part of the current from the constant current source flows through the resistor and the diode and, when the input signal becomes large, all the current from the constant current source flows through the base of the transistor, whereby the initial bias current is reduced, and the maximum output power is increased.

According to a fourth aspect of the present invention, a bias circuit for a bipolar transistor comprises a constant current source connected to a base electrode of the bipolar transistor; first and second resistors; and a switching transistor having first and second main electrodes and a control electrode, the first main electrode being connected through the first resistor to a node of the constant current source and the base electrode of the bipolar transistor, the second main electrode being connected to a grounding voltage terminal, and the control electrode being connected through the second resistor to a node of the constant current source and the base electrode of the bipolar transistor. Therefore, in the initial stage, a part of the current from the constant current source flows through the first resistor and the switching transistor and, when the input signal becomes large, all the current from the constant current source flows through the base of the bipolar transistor, whereby the initial bias current is reduced, and the maximum output power is increased.

According to a fifth aspect of the present invention, the above-mentioned bias circuit comprises a plurality of switching transistors. Therefore, in the initial stage, a part of the current from the constant current source flows through the first resistors and the switching transistors, and the switching transistors successively turn off with an increase in the input signal and, finally, all the current from the constant current source flows through the base of the bipolar transistor, whereby the initial bias current is reduced and the maximum output power is significantly increased.

BRIEF DESCRIPTION OF THE DRAWINGS

FIG. 15 is a diagram illustrating I/O characteristics of an HBT measured by biasing the HBT with a constant base current.

DETAILED DESCRIPTION OF THE PREFERRED EMBODIMENT

Embodiment 1

Figure 1:
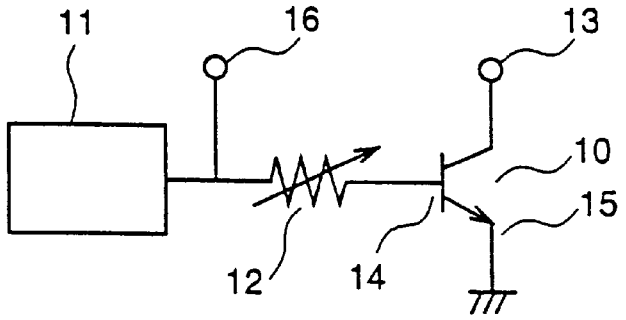
FIG. 1 is a diagram illustrating a bias circuit for a bipolar transistor according to a first embodiment of the invention.

FIG. 1 is a diagram illustrating a bias circuit for a bipolar transistor according to a first embodiment of the present invention. In FIG. 1, reference numeral 10 designates a bipolar transistor, numeral 11 designates a constant voltage source, numeral 12 designates a resistor (variable resistor), and numeral 16 designates an RF signal input terminal. Reference numerals 13, 14, and 15 designate collector, base, and emitter terminals of the bipolar transistor, respectively.

A description is given of the operation of the bias circuit. When the bipolar transistor 10 is operated with a constant base voltage, the base current $I_B$ increases with an increase in the RF signal input $P_{in}$. In the bias circuit according to the first embodiment, since the resistor 12 is connected in series between the constant voltage source 11 and the base terminal 14 of the bipolar transistor 10, although the voltage $V_B$ supplied from the constant voltage source 11 is constant, the voltage actually applied to the base terminal 14 of the bipolar transistor 10 becomes $V_B-\Delta V$ where $\Delta V$ is the voltage drop determined by $I_B$ (base current)$\times R_{12}$ (resistance of the resistor 12). That is, according to the magnitude of the input signal $P_{in}$, the voltage applied to the base electrode 14 of the transistor 10 varies, i.e., the bias point moves, whereby the operating class changes. Therefore, by appropriately selecting the resistance $R_{12}$ of the resistor 12, a high efficiency is realized at a desired $P_{out}$.

Figure 4:
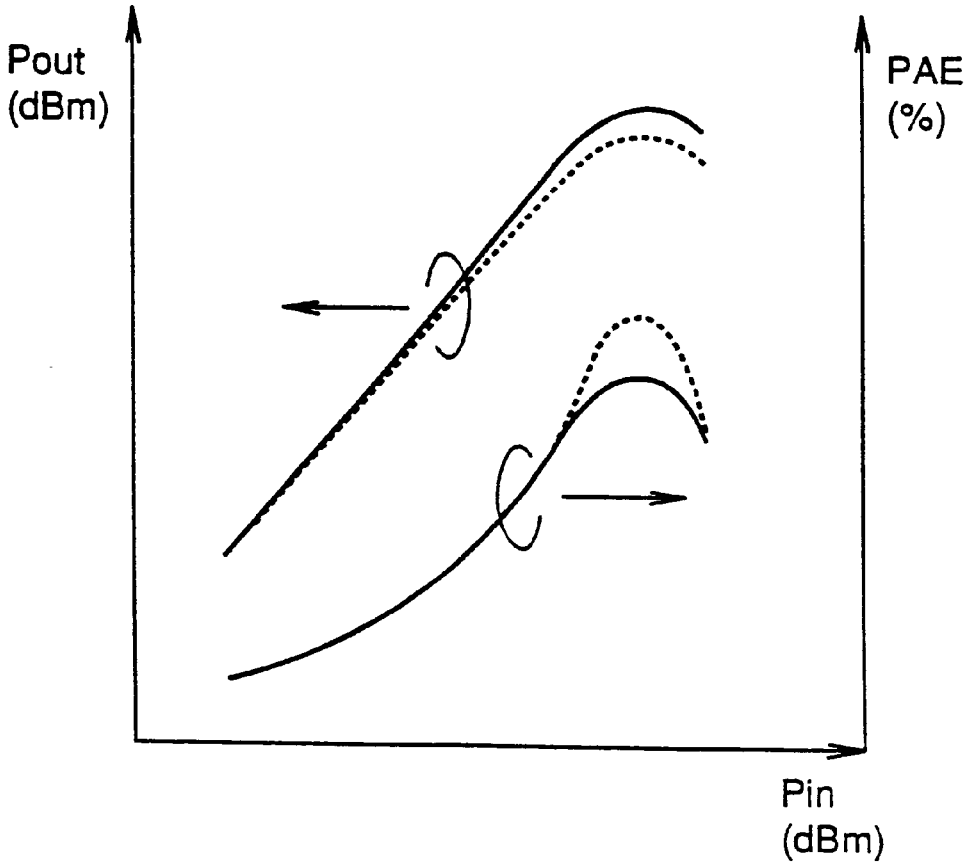
FIG. 4 is a diagram for explaining the effects of the bias circuit according to the first embodiment of the invention.

FIG. 4 is a diagram for explaining effects provided by the bias circuit according to the first embodiment. In FIG. 4, solid lines show the characteristics of a bipolar transistor operated by a conventional bias circuit with a constant base voltage, i.e., a bias circuit similar to the bias circuit shown in FIG. 1 but having no resistor 12, and the dotted lines show the characteristics of a bipolar transistor operated by the bias circuit according to the first embodiment of the invention. In the bias circuit according to the first embodiment, since the voltage applied to the base electrode drops by the voltage drop due to the resistor 12, although the maximum value of $P_{out}$ is lower than that provided by the conventional bias circuit, the bias point moves and the operating class changes, whereby the efficiency is improved.

To be specific, the resistance $R_{12}$ of the resistor 12 depends on the size of the bipolar transistor and a value of $P_{out}$ at which a high efficiency is desired. For example, for a transistor with $P_{out}$ of about 1 W, the resistance $R_{12}$ of the resistor 12 is about 50 Ω.

As described above, the bias circuit for a bipolar transistor according to the first embodiment of the invention includes the constant voltage source 11 connected to the base electrode of the bipolar transistor and the resistor 12 connected between the constant voltage source 11 and the base electrode 14 of the bipolar transistor. Therefore, by appropriately selecting the resistance of the resistor 12, the bias point moves due to the change in the voltage drop of the resistor 12, which change occurs because the base current flowing through the resistor 12 changes, whereby the operating class of the transistor changes, resulting in a high efficiency at desired $P_{out}$.

Figure 2:
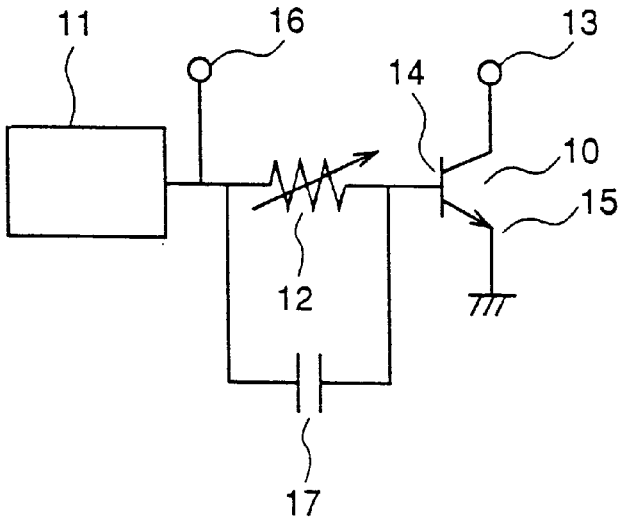
FIG. 2 is a diagram illustrating a bias circuit for a bipolar transistor according to a modification of the first embodiment of the invention.
Figure 3:
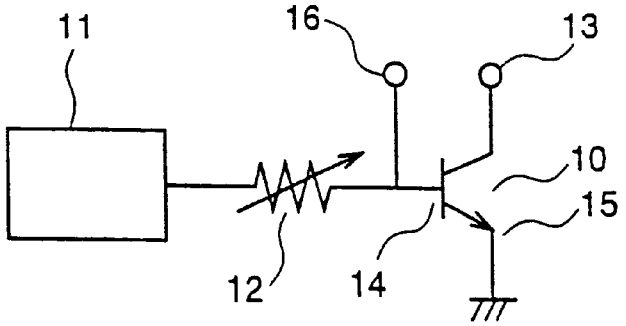
FIG. 3 is a diagram illustrating a bias circuit for a bipolar transistor according to a modification of the first embodiment of the invention.

When the loss of the RF power due to the resistor 12 poses a problem, as shown in FIG. 2, a capacitor 17 of an appropriate size is connected parallel to the resistor 12 to solve the problem of the power loss. Alternatively, as shown in FIG. 3, an RF signal may be input directly to the element (bipolar transistor 10).

Embodiment 2

Figure 5:
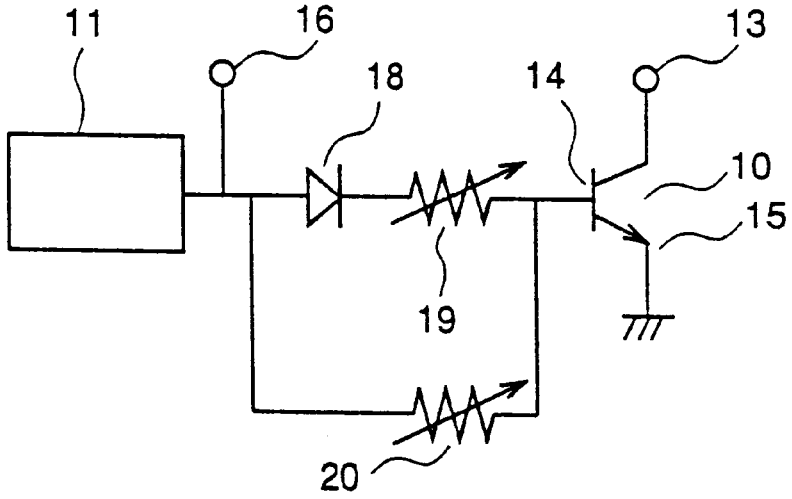
FIG. 5 is a diagram illustrating a bias circuit for a bipolar transistor according to a second embodiment of the invention.

FIG. 5 is a diagram illustrating a bias circuit for a bipolar transistor according to a second embodiment of the present invention. In FIG. 5, the same reference numerals as those shown in FIG. 1 designate the same or corresponding parts. Reference numeral 18 designates a diode, numeral 19 designates a first resistor (variable resistor), and numeral 20 designates a second resistor (variable resistor). The threshold voltage $V_{Dth}$ of the diode 18 is set at about 1.2 V, and the resistance $R_{19}$ of the first resistor 19 and the resistance $R_{20}$ of the second resistor 20 are appropriately selected so that the relationship, $R_{19} \ll R_{20}$, is satisfied.

A description is given of the operation of the inverter circuit.

Since $R_{19} << R_{20}$, when the diode 18 is in the ON state, most of the base current $I_B$ flows through the diode 18 and the first resistor 19. Though the voltage $V_B$ supplied from the constant voltage source 11 is constant, the voltage applied to the diode 18 is given by $V_B - \Delta V_1$ where $\Delta V_1$ is the voltage drop determined by the product of the base current $I_B$ which varies according to the input signal and the resistance $R_{19}$ of the first resistor 19, more specifically, the product of the base current $I_B$ and the sum of the resistance $R_{18}$ in the forward direction of the diode and the resistance $R_{19}$ of the first resistor 19. When the input signal increases and $V_B - \Delta V_1$ becomes lower than the threshold voltage $V_{Dth}$ of the diode 18, the base current $I_B$ flows through the second resistor 20 of the resistance $R_{20}$. Since $R_{20} >> R_{19}$, the voltage drop $\Delta V_2$ due to the second resistor 20, which is determined by $R_{20} \times I_B$, is larger than $\Delta v_1$, and the voltage $V_B$ applied to the base terminal 14 of the transistor 10 suddenly drops.

By appropriately selecting the resistances $R_{19}$ and $R_{20}$, when a desired $P_{out}$ is reached, $V_B - \Delta v_1$ becomes lower than the threshold voltage $V_{Dth}$ of the diode 18, so that the base current $I_B$ flows through the second resistor 20. Accordingly, when the desired $P_{out}$ is reached, both rapid movement of the bias point and rapid change of the operating class are realized, whereby a high efficiency is realized.

Figure 8:
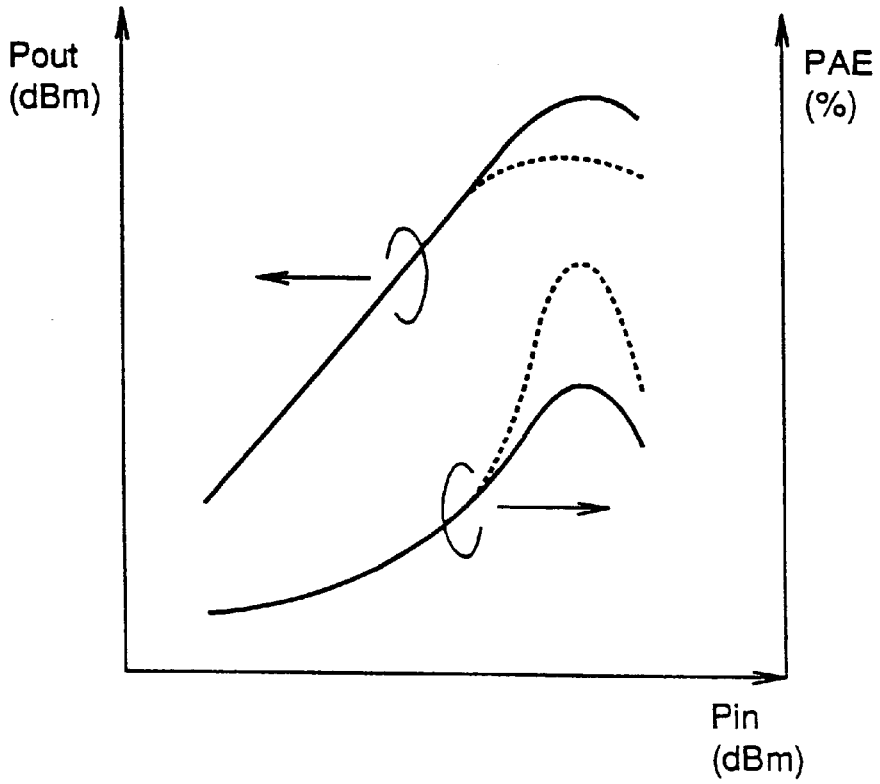
FIG. 8 is a diagram for explaining the effects of the bias circuit according to the second embodiment of the invention.

FIG. 8 is a diagram for explaining effects provided by the bias circuit according to this second embodiment of the invention. In FIG. 8, solid lines show the characteristics of a bipolar transistor operated by a conventional bias circuit with a constant base voltage, i.e., a bias circuit obtained by excluding the diode 18 and the resistors 19 and 20 from the circuit shown in FIG. 5, and the dotted lines show the characteristics of a bipolar transistor operated by the bias circuit according to this second embodiment of the invention. In the bias circuit according to this second embodiment, since the voltage applied to the base electrode drops by the voltage drop due to the resistor 20, although the maximum value of $P_{out}$ is lower than that provided by the conventional bias circuit, the bias point moves and the operating class changes rapidly, whereby the efficiency is improved.

The resistances $R_{19}$ and $R_{20}$ depend on the size of the bipolar transistor. For example, when a bipolar transistor having a $P_{out}$ of about 1 W is employed, the resistance $R_{19}$ is 5 Ω and the resistance $R_{20}$ is 100 Ω.

As described above, the bias circuit for a bipolar transistor according to the second embodiment of the invention includes the constant voltage source 11, the diode 18 and the resistor 19 which are connected in series between the constant voltage source 11 and the base electrode 14 of the bipolar transistor 10, and a second resistor 20 connected between the constant power source 11 and the base electrode 14 of the bipolar transistor in parallel with the diode 18 and the resistor 19. The second resistor has the resistance $R_{20}$ which is higher than the sum of the resistance $R_{18}$ in the ON state of the diode and the resistance $R_{19}$ of the first resistor. Therefore, when the base voltage becomes lower than the threshold voltage of the diode due to an increase in the voltage drop of the diode 18 and the first resistor 19, which increase occurs because the base current flowing through the diode 18 and the first resistor 19 increases, the base current flows through the second resistor, whereby the bias point moves rapidly due to the voltage drop by the second resistor, and the operating class of the transistor changes, resulting in a high efficiency at a desired $P_{out}$.

Figure 6:
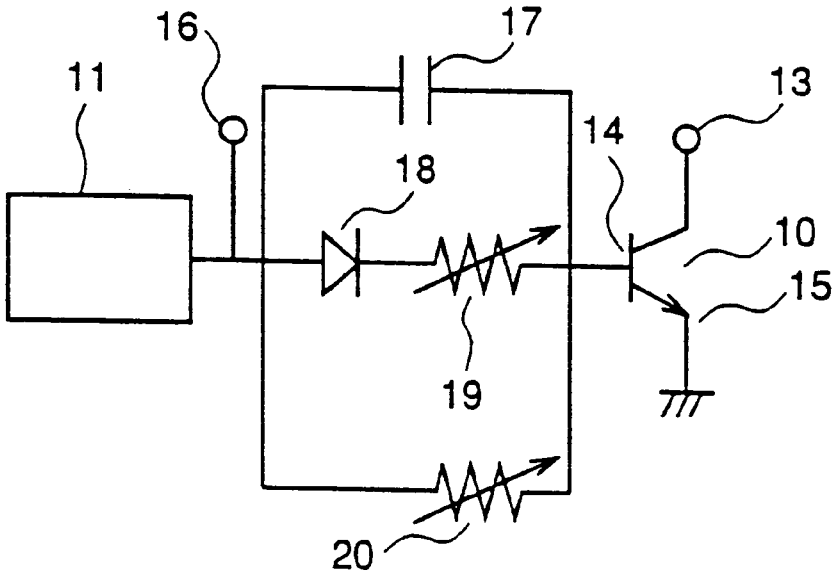
FIG. 6 is a diagram illustrating a bias circuit for a bipolar transistor according to a modification of the second embodiment of the invention.
Figure 7:
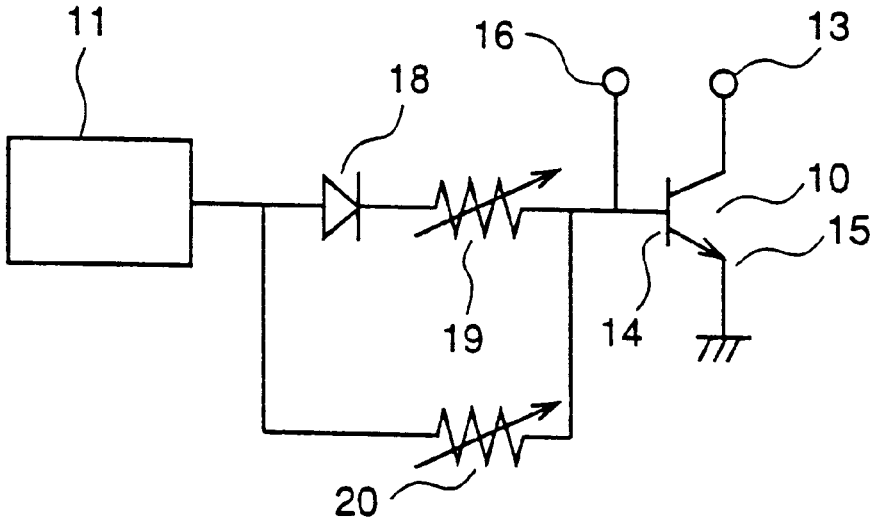
FIG. 7 is a diagram illustrating a bias circuit for a bipolar transistor according to a modification of the second embodiment of the invention.

When the loss of RF power due to the resistor poses a problem, as shown in FIG. 6, a capacitor 17 of an appropriate size is connected parallel with the diode 18 and the resistors 19 and 20 to solve the problem of the power loss. Alternatively, as shown in FIG. 7, an RF signal may be input from an end of the element (bipolar transistor 10).

Embodiment 3

Figure 9:
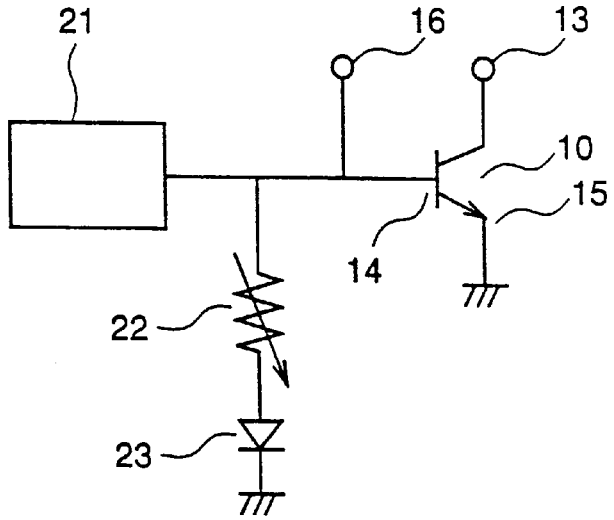
FIG. 9 is a diagram illustrating a bias circuit for a bipolar transistor according to a third embodiment of the invention.

FIG. 9 is a diagram illustrating a bias circuit for a bipolar transistor according to a third embodiment of the present invention. In FIG. 9, the same reference numerals as those shown in FIG. 1 designate the same or corresponding parts. Reference numeral 21 designates a constant current source, numeral 22 designates a resistor (variable resistor), and numeral 23 designates a diode. The threshold voltage $V_{Dth}$ of the diode 23 is set at about 1.2 V.

A description is given of the operation of the bias circuit. When the current flowing out of the constant current source 21 is $I_B$ , the current flowing through the resistor 22 of a resistance R and the diode 23 is $I_{B1}$, and the current injected into the transistor 10 is $I_{B1}$, the relationship, $I_B = I_{B1} + I_{B2}$, stands.

When $P_{in}$ increases, the voltage applied to the base terminal 14 of the transistor 10 decreases to maintain the base current $I_B$ constant, as described for the prior art bias circuit. Hence, when the voltage applied to the resistor 22 and the diode 23 becomes lower than the threshold voltage $V_{Dth}$ of the diode 23, no current flows through the resistor 22 and the diode 23. That is, the current, $I_B = I_{B1} + I_{B2}$, is injected into the transistor 10. More specifically, when the amplification factor of the transistor 10 is β, the total current flowing into the bipolar transistor 10 is, initially, $(\beta+1)I_{B1}$, but this total current can be increased to $(\beta+1)(I_{B1}+I_{B2})$ with an increase in $P_{in}$. Therefore, it is possible to increase $P_{out}$ while reducing $I_{idle}$ (total current when $P_{in}$=0 dBm). Further, the reduction in $I_{idle}$ suppresses an increase in the junction temperature.

Figure 11:
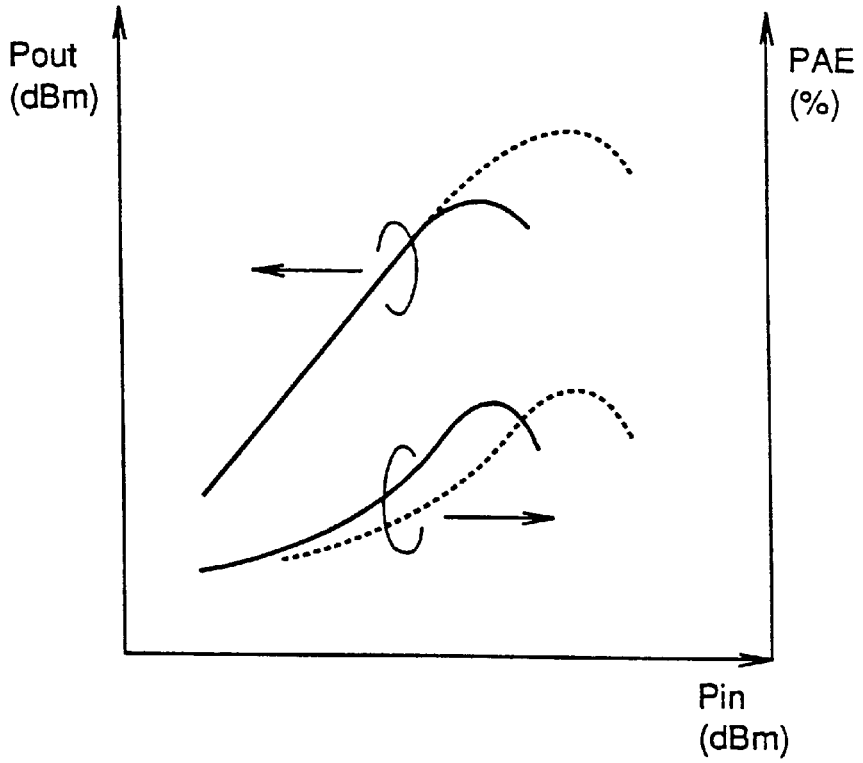
FIG. 11 is a diagram for explaining the effects of the bias circuits according to the third and fourth embodiments of the invention.

FIG. 11 is a diagram for explaining effects provided by the bias circuit according to the third embodiment of the invention. In FIG. 11, solid lines show the characteristics of a bipolar transistor operated by a conventional bias circuit with a constant base current, i.e., a bias circuit realized by removing the resistor 22 and the diode 23 from the circuit shown in FIG. 9, and dotted lines show the characteristics of a bipolar transistor operated by the bias circuit according to this third embodiment. In the bias circuit according to this third embodiment, the maximum value of $P_{out}$ can be increased.

The resistance $R_{22}$ of the resistor 22 is selected so that the impedance faced by the input signal at the resistor 22 is about 100 times as high as the impedance at the transistor. Although the specific value of the resistance $R_{22}$ depends on the size of the bipolar transistor, when a bipolar transistor having $P_{out}$ of about 1 W is employed, the resistance $R_{22}$ is about 50 Ω.

As described above, the bias circuit for a bipolar transistor according to the third embodiment of the invention includes the constant current source 21, and the resistor 22 and the diode 23 which are connected in series between the grounding voltage and a node of the constant current source 21 and the base electrode 14 of the bipolar transistor. Therefore, in the initial stage, a part of the current from the constant current source flows through the resistor 22 and the diode 23 and, when the input signal becomes large, all the current from the constant current source flows through the base of the transistor, whereby the initial bias current is reduced and the maximum value of $P_{out}$ is increased.

Embodiment 4

Figure 10:
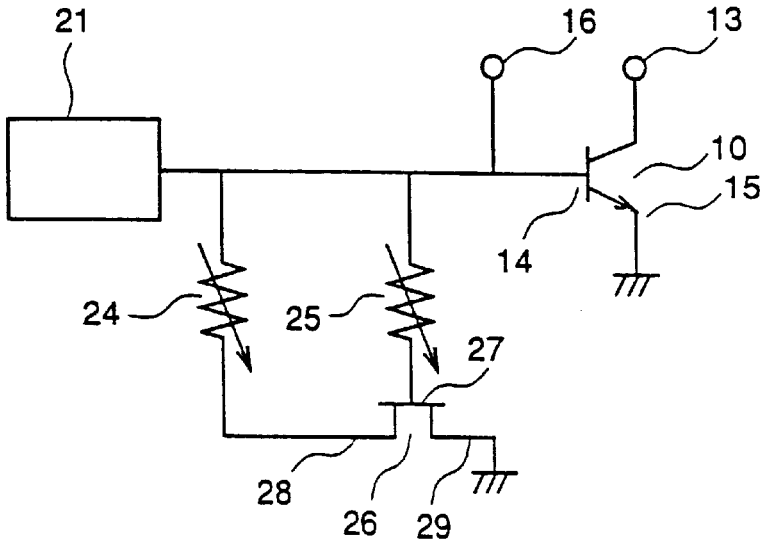
FIG. 10 is a diagram illustrating a bias circuit for a bipolar transistor according to a fourth embodiment of the invention.

FIG. 10 is a diagram illustrating a bias circuit for a bipolar transistor according to a fourth embodiment of the present invention. In FIG. 10, the same reference numerals as those shown in FIG. 9 designate the same or corresponding parts. Reference numeral 24 designates a first resistor (variable resistor), numeral 25 designates a second resistor (variable resistor), and numeral 26 designates an FET. Reference numerals 27, 28, and 29 designate gate, drain, and source terminals of the FET 26, respectively. The threshold voltage $V_{Fth}$ of the FET 26 is about 1.2 V.

The resistance $R_{24}$ of the first resistor 24 and the resistance $R_{25}$ of the second resistor 25 are selected so that the impedance faced by the input signal at the resistor is about 100 times as high as the impedance at the bipolar transistor. Although the specific value of the resistance depends on the size of the bipolar transistor, when a bipolar transistor having $P_{out}$ of about 1 W is employed, the resistance of each resistor is about 50 Ω.

A description is given of the operation of the bias circuit.

When the current flowing through the first resistor 24 having the resistance $R_{24}$ and into the FET 26 is $I_{B1}$, the current injected into the bipolar transistor 10 is $I_{B2}$, and the current flowing out of the constant current source 21 is $I_B$, the relationship, $I_B=I_{B1}+I_{B2}$, stands.

When $P_{in}$ increases, the base-emitter voltage across terminals 14 and 15 of the transistor 10 decreases to maintain the base current $I_B$ constant. Hence, when the source-gate voltage across the gate and source terminals 27 and 28 of the FET 26 decreases and becomes lower than the ON voltage $V_{Fth}$ of the FET 26, no current flows through the first resistor 24 of the resistance $R_{24}$ and the FET 26. As a result, all the current $I_B$ ($=I_{B1}+I_{B2}$) is injected into the bipolar transistor 10. More specifically, when the amplification factor of the transistor 10 is β, the total current flowing into the bipolar transistor 10 is, initially, $(\beta+1)I_{B1}$, but this total current can be increased to $(\beta+1)(I_{B1}+I_{B2})$ with an increase in $P_{in}$. Therefore, it is possible to increase $P_{out}$ while reducing $I_{idle}$. The reduction in $I_{idle}$ suppresses an increase in the junction temperature.

The bipolar transistor operated by the bias circuit according to this fourth embodiment has the characteristics shown by the dotted lines in FIG. 11. That is, the maximum value of $P_{out}$ is increased by the bias circuit according to this fourth embodiment.

As described above, the bias circuit for a bipolar transistor according to the fourth embodiment of the invention includes the constant current source 21 and the FET 26, the drain 28 of which is connected through the first resistor 24 to the node of the constant current source 21 and the base electrode 14 of the bipolar transistor, the source 29 of which is connected to the grounding voltage, and the gate 27 of which is connected through the second resistor 25 to the node of the constant current source 21 and the base electrode 14 of the bipolar transistor. Therefore, in the initial stage, a part of the current from the constant current source flows through the resistor 24 and the FET 26 and, when the input signal becomes large, all the current from the constant current source flows through the base of the transistor, whereby the initial bias current is reduced and the maximum value of $P_{out}$ is increased.

Furthermore, in the bias circuit according to this fourth embodiment, since the amount of current flowing through the transistor 10 is changed by the ON/OFF switching of the FET 26, the degree of freedom of $V_{th}$ is increased as compared with the bias circuit according to the third embodiment of the invention. Further, $I_{B2}$ decreases gradually with a reduction in the voltage applied to the gate terminal 27. The decrease in $I_{B2}$, a current injected into the bipolar transistor 10, gradually increases the total current, as compared with the diode used for the third embodiment. Furthermore, by selecting the characteristics of the FET, the decease of $I_{B2}$ with a reduction in the voltage can be controlled.

While in this fourth embodiment an FET is employed as the switching transistor 26, a bipolar transistor may be employed in place of the FET.

Embodiment 5

Figure 12:
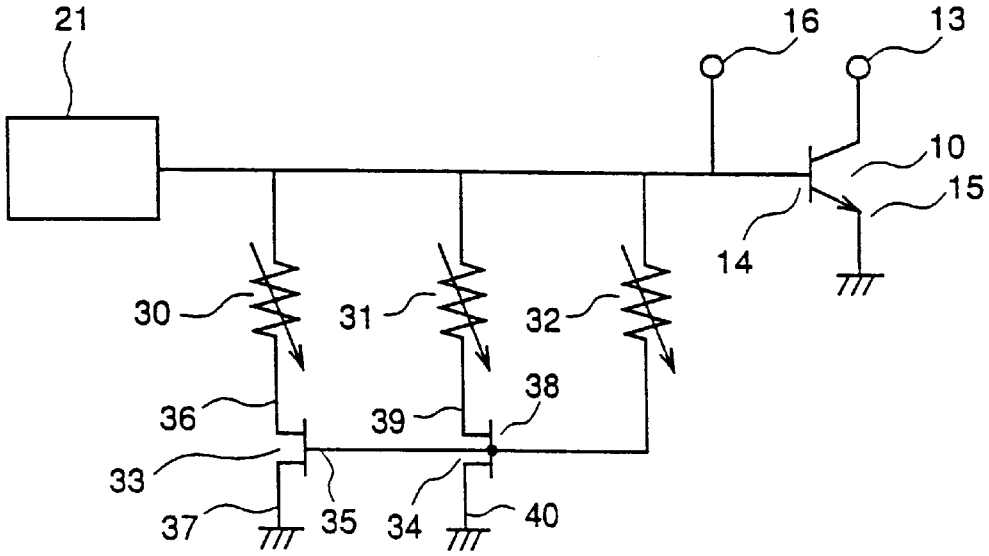
FIG. 12 is a diagram illustrating a bias circuit for a bipolar transistor according to a fifth embodiment of the invention.

FIG. 12 is a diagram illustrating a bias circuit for a bipolar transistor according to a fifth embodiment of the present invention. In the figure, the same reference numerals as those shown in FIG. 10 designate the same or corresponding parts. Reference numeral 30 designates a first resistor (variable resistor), numeral 31 designates a second resistor (variable resistor), numeral 32 designates a third resistor (variable resistor), numeral 33 designates a first FET, and numeral 34 designates a second FET. Reference numerals 35, 36, and 37 designate gate, drain, and source terminals of the first FET 33, respectively, and numerals 38, 39, and 40 designate gate, drain, and source terminals of the second FET 34, respectively. The threshold voltage $V_{th1}$ of the first FET 33 is about 1.2 V, and the threshold voltage $V_{th2}$ of the second FET 34 is about 1.0 V.

The resistance $R_{30}$ of the first resistor 30, the resistance $R_{31}$ of the second resistor 31, and the resistance $R_{32}$ of the third resistor 32 are selected so that the impedance faced by the input signal of the resistor is about 100 times as high as at the bipolar transistor. Although specific values of the resistances depend on the size of the bipolar transistor, when a transistor having $P_{out}$ of about 1 W is employed, the resistance of each resistor is about 50 Ω.

A description is given of the operation of the bias circuit.

It is assumed that the current flowing through the first resistor 30 of the resistance $R_{30}$ to the first FET 33 is $I_{B1}$, the current flowing through the second resistor 31 of the resistance $R_{31}$ to the second FET 34 is $I_{B2}$, and the current injected into the bipolar transistor 10 is $I_{B3}$, When the current flowing out of the constant current source 21 is $I_B$, the relationship, $I_B=I_{B1}+I_{B2}+I_{B3}$, stands. When $P_{in}$ increases, the base emitter voltage across the base and emitter terminals 14 and 15 of the bipolar transistor 10 decreases to keep $I_B$ constant. Therefore, when the voltage across the gate and source terminals 35, 36 and 38, 39 of the first and second FETs 33 and 34 decreases and becomes lower than the threshold voltage $V_{th1}$ of the first FET 33, no current flows through the first resistor 30 of the resistance $R_{30}$ and the first FET 33. That is, a current of $I_{B1}+I_{B2}$ is injected into the bipolar transistor 10.

Further, when $P_{in}$ increases and the voltage at the gate terminals 35 and 38 becomes lower than the threshold voltage $V_{th2}$ of the second FET 34, no current flows through the second resistor 31 of the resistance $R_{31}$ and the second FET 34. That is, a current of $I_B=I_{B1}+I_{B2}+I_{B3}$ is injected into the bipolar transistor 10. That is, when the amplification factor of the transistor is β, the total current flowing into the bipolar transistor 10 is, initially, $(\beta+1)I_{B1}$, but this total current can be increased to $(\beta+1)(I_{B1}+I_{B2})$ with an increase in $P_{in}$ and, furthermore, it can be increased to $(\beta+1)(I_{B1}+I_{B2}+I_{B3})$.

Figure 13:
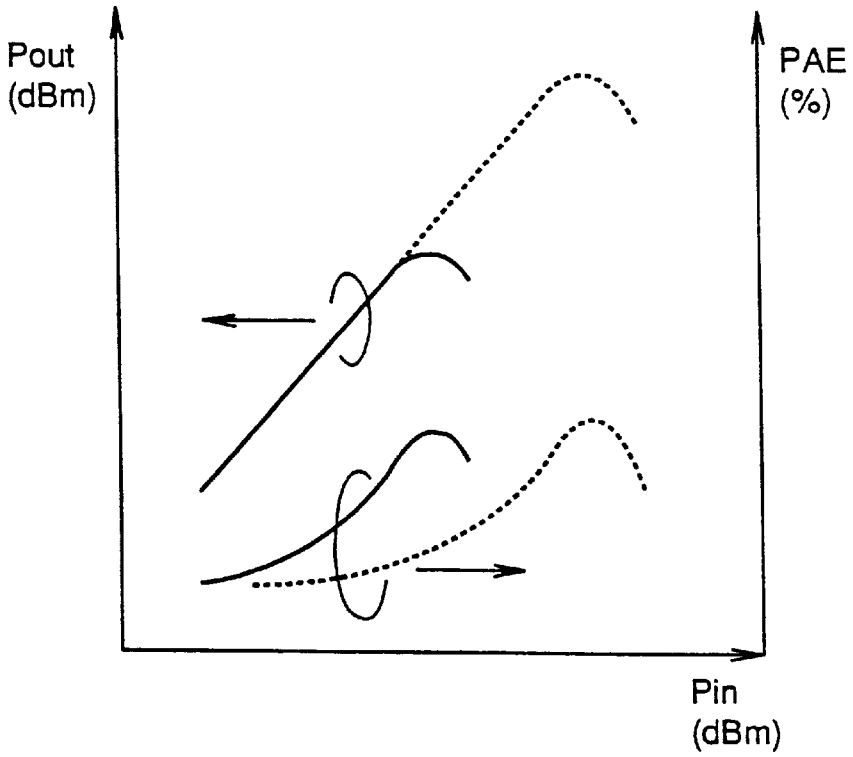
FIG. 13 is a diagram for explaining the effects of the bias circuit according to the fifth embodiment of the invention.
Figure 14:
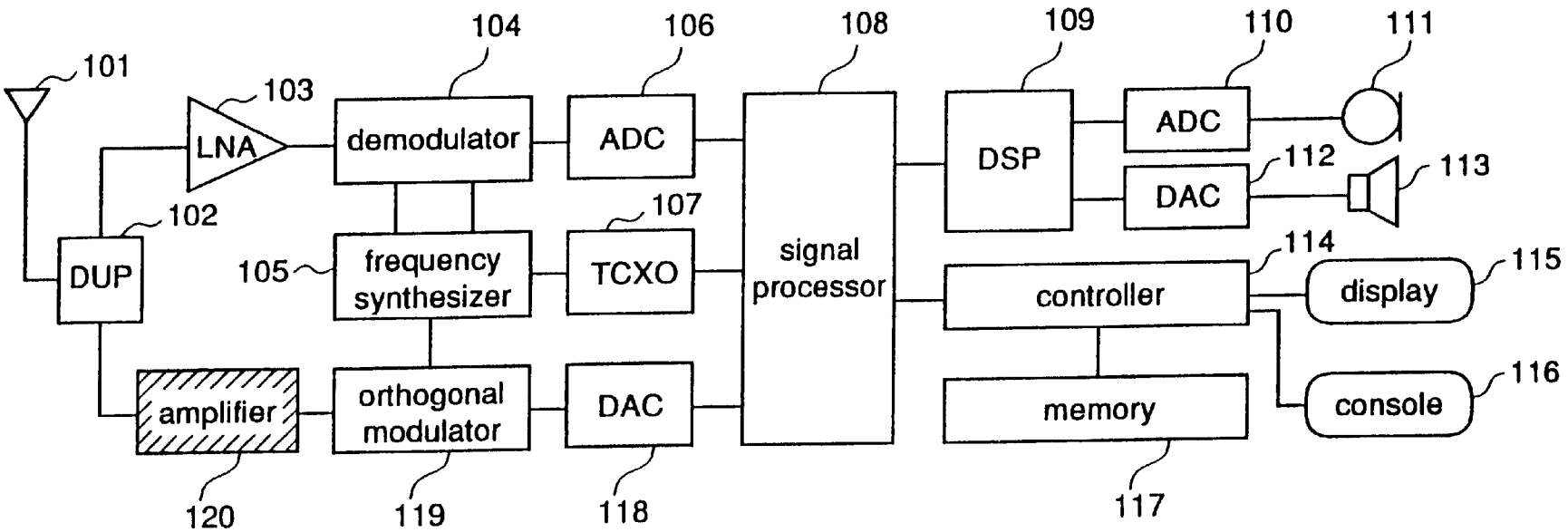
Fig.14 Prior Art
FIG. 14 is a block diagram illustrating a circuit structure of a digital portable telephone.
Figure 16:
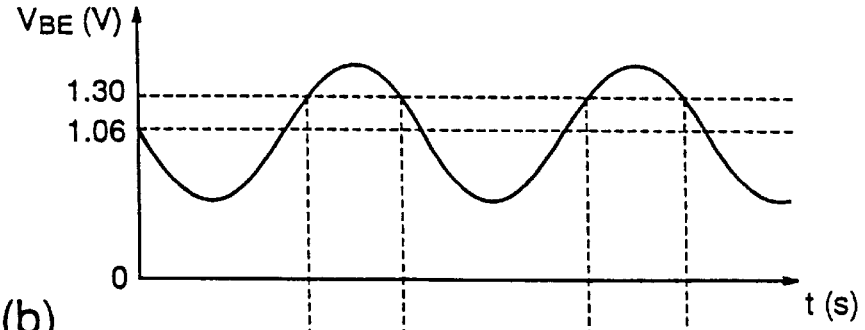
Prior Art Fig.16 (a)
FIGS. 16(*a*) and 16(*b*) are diagrams illustrating changes of the base voltage and the collector current with time, respectively, when the highest efficiency in FIG. 15 is attained.
Figure 16:
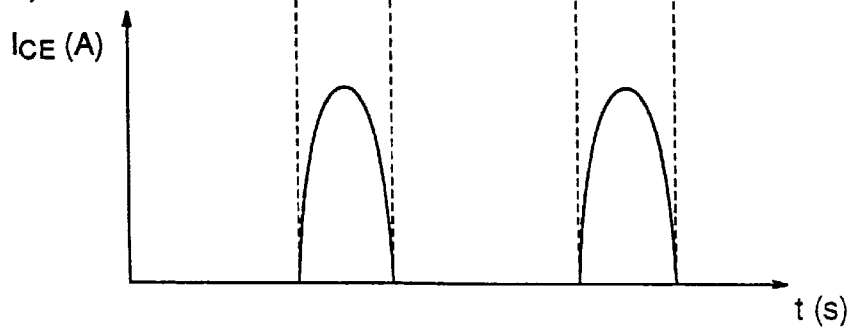
Figure 17:
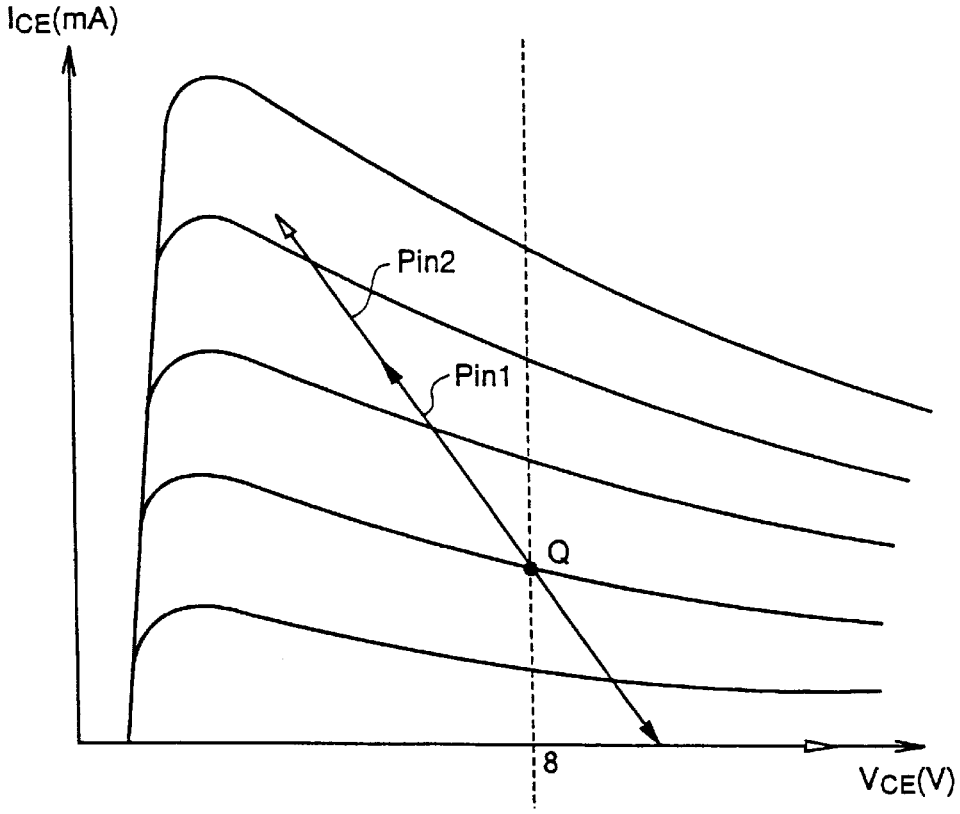
Fig.17 Prior Art
FIG. 17 is a diagram illustrating load curves on the assumption that the bias point does not move in the HBT having the characteristics shown in FIG. 15.
Figure 18:
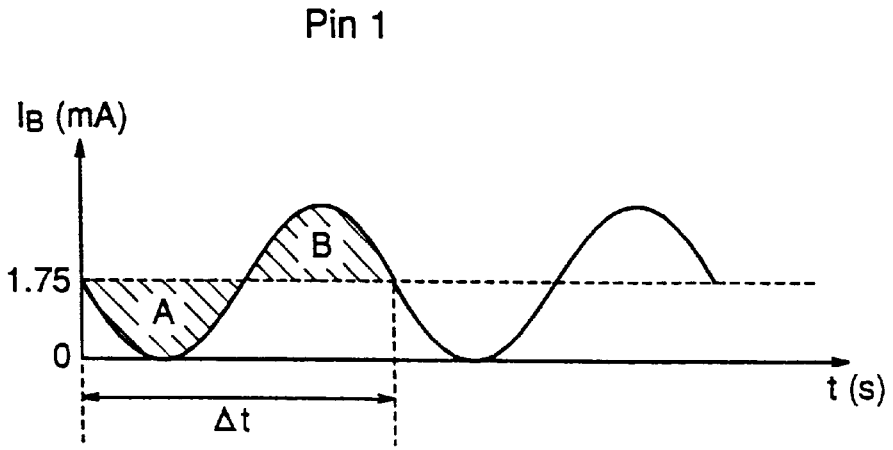
Prior Art Fig.18 (a)
FIGS. 18(*a*) and 18(*b*) are diagrams illustrating changes of the base current and the collector current with time, respectively, when the input amplitude is small, on the assumption that the bias point does not move in the HBT having the characteristics shown in FIG. 15.
Figure 18:
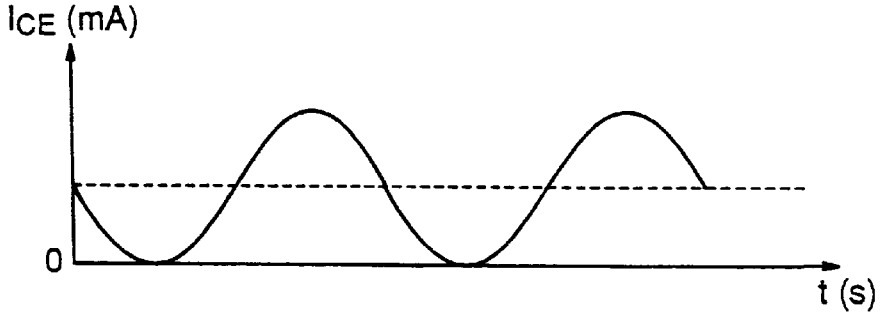
Figure 19:
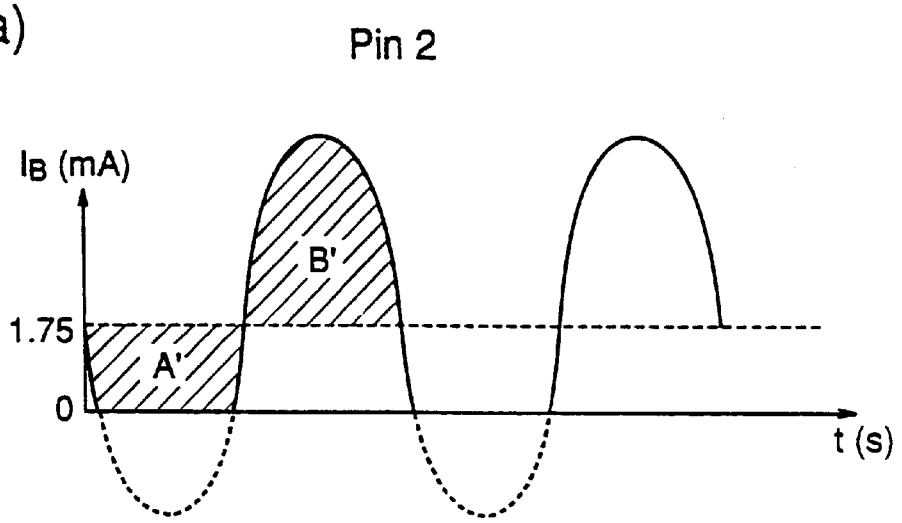
Prior Art Fig.19 (a)
FIGS. 19(*a*) and 19(*b*) are diagrams illustrating changes of the base current and the collector current with time, respectively, when the input amplitude is large, on the assumption that the bias point does not move in the HBT having the characteristics shown in FIG. 15.
Figure 19:
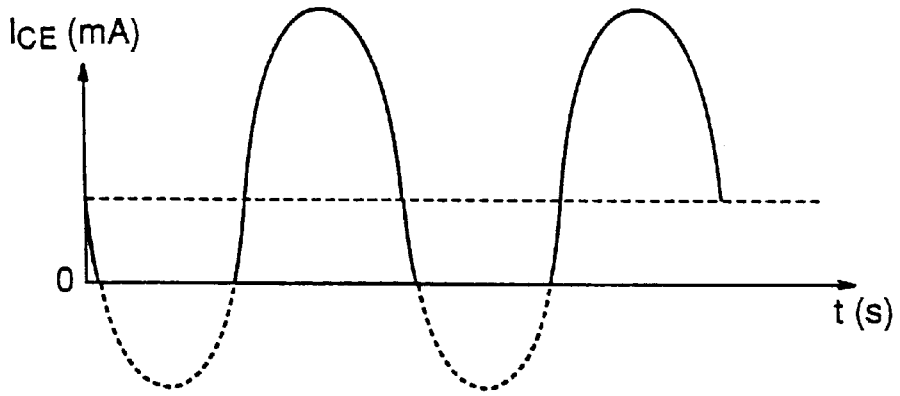
Figure 20:
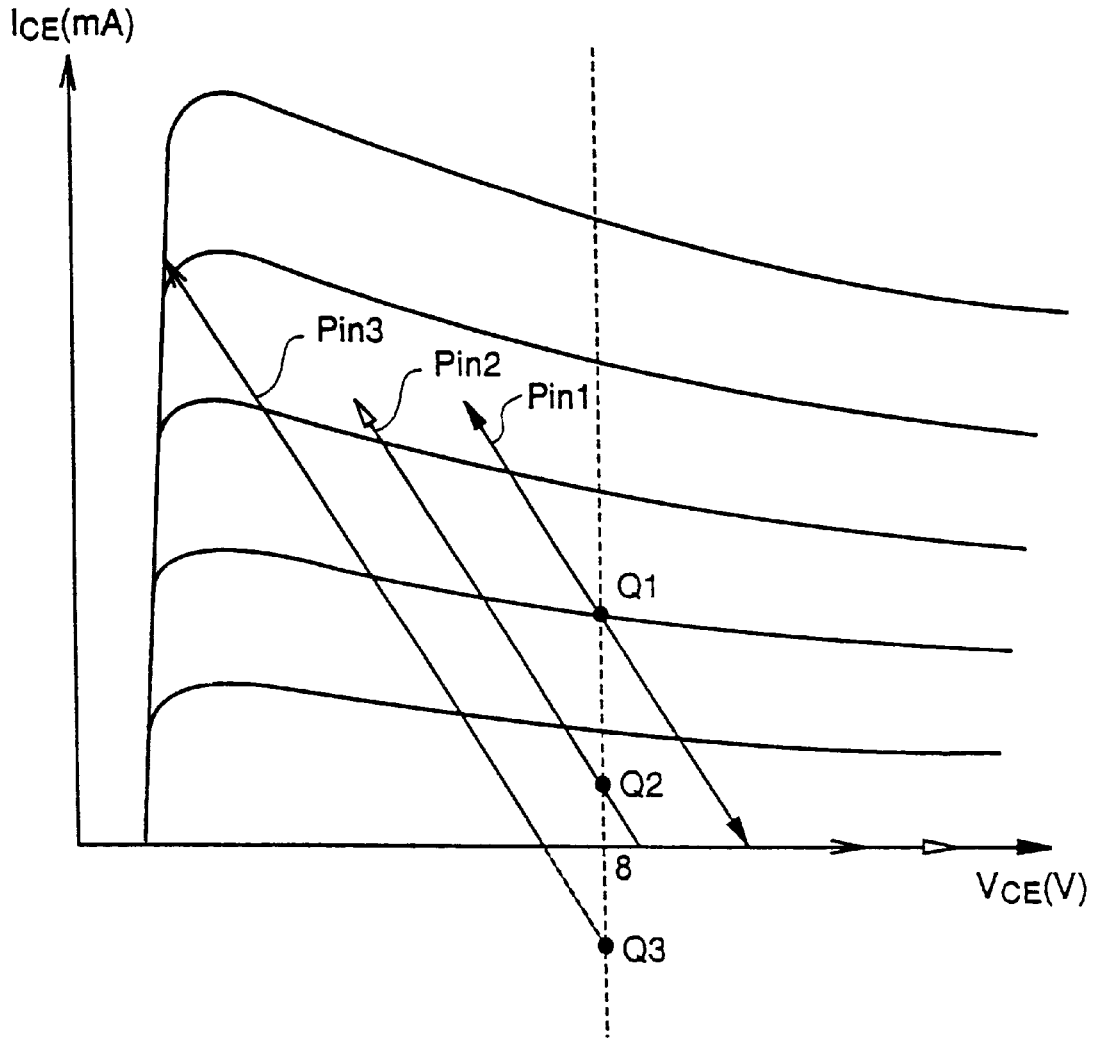
Fig.20 Prior Art
FIG. 20 is a diagram illustrating load curves when the bias point moves downwards with an increase in the input amplitude, in the HBT having the characteristics shown in FIG. 15.
Figure 21:
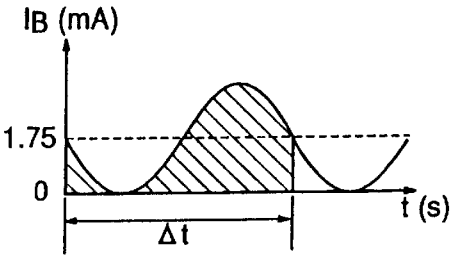
Prior Art Fig.21 (a)
FIGS. 21(*a*)–21(*f*) are diagrams illustrating changes of the base current and the collector current with time on the assumption that the bias point does not move in the HBT having the characteristics shown in FIG. 15.
Figure 21:
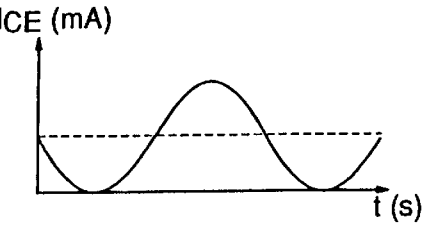
Prior Art Fig.21 (b)
Figure 21:
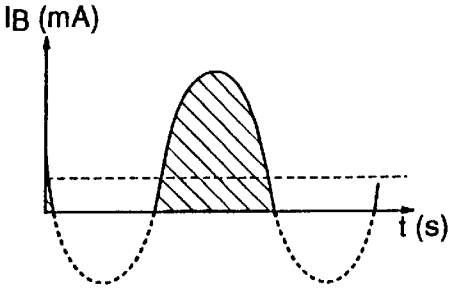
Prior Art Fig.21 (c)
Figure 21:
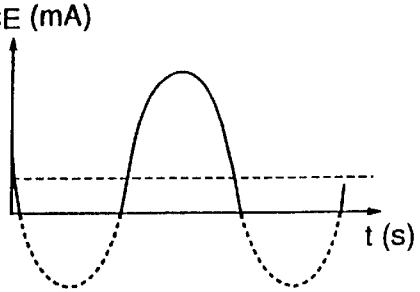
Prior Art Fig.21 (d)
Figure 21:
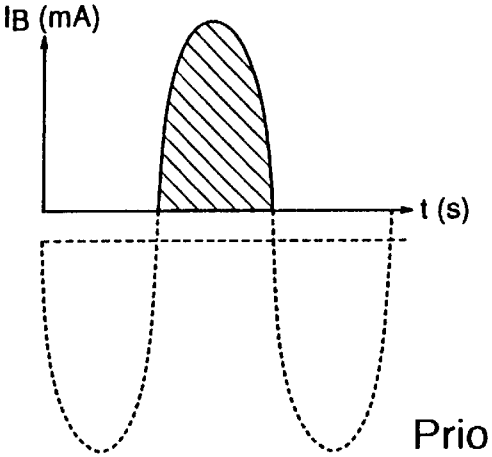
Prior Art Fig.21 (e)
Figure 21:
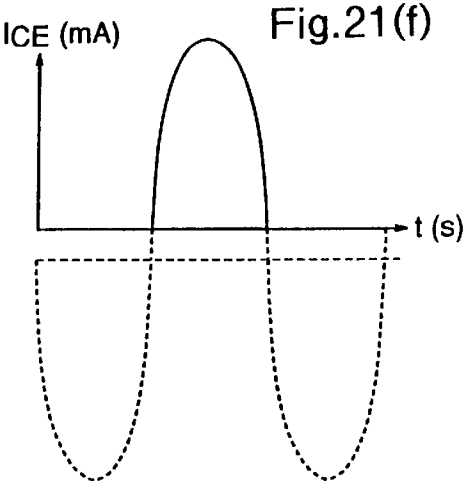
Prior Art Fig.21 (f)

FIG. 13 is a diagram for explaining effects provided by the bias circuit according to the fifth embodiment of the invention. In FIG. 13, solid lines show the characteristics of a bipolar transistor operated by a conventional bias circuit with a constant base voltage, i.e., a bias circuit obtained by removing the resistors 30 to 32 and FETs 33 and 34 from the circuit shown in FIG. 12, and the dotted lines show the characteristics of a bipolar transistor operated by the bias circuit according to the fifth embodiment of the invention. In the bias circuit according to the fifth embodiment, as shown in FIG. 13, the maximum value of $P_{out}$ is significantly increased.

As described above, the bias circuit according to this fifth embodiment includes the constant current source 21 and two FETs 33 and 34, drain electrodes 36 and 39 connected through the first resistors 30 and 31 to the node of the constant current source 21 and the base electrode 14 of the bipolar transistor, the source electrodes 37 and 40 connected to the grounding voltage, and the gate electrodes 35 and 38 connected through the second resistor 32 to the node of the constant current source 21 and the base electrode 14 of the bipolar transistor. Therefore, in the initial stage, a part of the current from the constant current source flows through the first resistors and the FETS, and the FETs successively turn off with an increase in the input signal and, finally, all the current from the constant current source flows through the base of the transistor, whereby the initial bias current is reduced and the maximum value of $P_{out}$ is significantly increased.

Since the control range of $I_B$ can be extended by using plural FETs having different threshold voltages $V_{Fth}$, $P_{out}$ is further increased while decreasing $I_{idle}$, as compared with the bias circuit according to the fourth embodiment of the invention.

Furthermore, since plural FETs having different threshold voltages are employed and the characteristics of the FETs are selected, the control range of current injected into the bipolar transistor is extended, and the rate of change of input current with a reduction in voltage is controlled freely, as compared with the bias circuit according to the fourth embodiment.

Although two FETs are employed in the bias circuit according to the fifth embodiment, three or more FETs may be employed to increase the degree of freedom in controlling the injected current.

Although in the fifth embodiment FETs are employed as the switching transistors 33 and 34, bipolar transistors may be employed in place of the FETs.

Furthermore, although it is not mentioned in the first to fifth embodiments of the invention, in the path from the input terminal 16 to the base electrode 14 of the bipolar transistor 10, a matching circuit for matching the impedance of the transistor to the characteristic impedance of a circuit to be connected to the input terminal 16 may be inserted.

Furthermore, in the first to fifth embodiments of the invention, since the bias circuits are constructed using variable resistors, appropriate resistances are easily set in the device design stage. However, it is not necessary for the resistors to be variable in the fabrication stage of the products, so that resistors having resistances fixed at the design values are employed.

Furthermore, in the first to fifth embodiments of the invention, the threshold voltages of the diodes and the FETs and the resistances of the resistors are selected on the assumption that the bipolar transistor to be biased is an AlGaAs/GaAs series HBT. These threshold voltages and resistances vary according to the kind and the material of the bipolar transistor.

What is claimed is:

1. A bias circuit for a bipolar transistor comprising:

a bipolar transistor;

a constant current source connected to a base electrode of the bipolar transistor;

first and second resistors; and a first switching transistor having first and second main electrodes and a control electrode, the first main electrode being connected through the first resistor to a node of the constant current source and the base electrode of the bipolar transistor, the second main electrode being connected to a grounding voltage terminal, and the control electrode being connected through the second resistor to a node of the constant current source and the base electrode of the bipolar transistor.

2. The bias circuit of claim 1 wherein the first switching transistor is a field effect transistor, the first and second main electrodes are a source and a drain, respectively, and the control electrode is a gate.

3. The bias circuit of claim 1 wherein the first switching transistor is a bipolar transistor, the first and second main electrodes are an emitter and a collector, respectively, and the control electrode is a base.

4. The bias circuit of claim 1 comprising a plurality of switching transistors.

5. The bias circuit of claim 2 comprising a plurality of switching transistors.

6. The bias circuit of claim 3 comprising a plurality of switching transistors.

7. The bias circuit of claim 1 including a third resistor and a second switching transistor having first and second main electrodes and a control electrode, the first main electrode of the second switching transistor being connected through the third resistor to a node of the constant current source and the base electrode of the bipolar transistor, the second main electrode of the second switching transistor being connected to the grounding voltage terminal, and the control electrode of the second switching transistor being connected to the control electrode of the first switching transistor.

* * * * *